US010268226B1

(12) United States Patent
Wang et al.

(10) Patent No.: US 10,268,226 B1
(45) Date of Patent: Apr. 23, 2019

(54) VOLTAGE GENERATING DEVICE AND CALIBRATING METHOD THEREOF

(71) Applicant: Faraday Technology Corp., Hsinchu (TW)

(72) Inventors: Wei Wang, Suzhou (CN); Xiao-Dong Fei, Suzhou (CN)

(73) Assignee: Faraday Technology Corp., Hsin-Chu (TW)

( * ) Notice: Subject to any disclaimer, the term of this patent is extended or adjusted under 35 U.S.C. 154(b) by 0 days.

(21) Appl. No.: 15/925,781

(22) Filed: Mar. 20, 2018

(30) Foreign Application Priority Data

Jan. 16, 2018 (CN) ..... 2018 1 0039600

(51) Int. Cl.
*G05F 3/22* (2006.01)
*G05F 3/30* (2006.01)

(52) U.S. Cl.
CPC ..... *G05F 3/222* (2013.01); *G05F 3/30* (2013.01)

(58) Field of Classification Search
CPC ..... G05F 3/30; G05F 3/222; G05F 1/463
See application file for complete search history.

(56) References Cited

U.S. PATENT DOCUMENTS

| | | | | |
|---|---|---|---|---|
| 7,342,390 | B2 | 3/2008 | Tachibana et al. | |
| 8,680,839 | B2 | 3/2014 | Venkiteswaran S. et al. | |
| 9,459,641 | B2 | 10/2016 | Sakaguchi et al. | |
| 2013/0069616 | A1* | 3/2013 | Venkiteswaran S ..... | G05F 3/30 323/313 |
| 2016/0334816 | A1* | 11/2016 | Ji ..... | G05F 1/463 |

* cited by examiner

*Primary Examiner* — Jue Zhang
*Assistant Examiner* — Jye-June Lee
(74) *Attorney, Agent, or Firm* — Winston Hsu

(57) ABSTRACT

The disclosure provides a voltage generating device and a calibrating method thereof. The voltage generating device includes a bandgap circuit, a regulator circuit and a calibrating circuit. The bandgap circuit provides a bandgap voltage. The regulator circuit generates an output voltage correspondingly according to the bandgap voltage. In a first stage of a calibration period, the calibrating circuit detects the bandgap voltage, and correspondingly sets a resistance of at least one resistor of the bandgap circuit according to the bandgap voltage. In a second stage of the calibration period, the calibrating circuit detects the output voltage, and correspondingly sets a resistance of at least one resistor of the regulator circuit according to the output voltage.

9 Claims, 4 Drawing Sheets

VOLTAGE GENERATING DEVICE AND CALIBRATING METHOD THEREOF

CROSS-REFERENCE TO RELATED APPLICATION

This application claims the priority benefit of China application serial no. 201810039600.7, filed on Jan. 16, 2018. The entirety of the above-mentioned patent application is hereby incorporated by reference herein and made a part of this specification.

BACKGROUND

Field of the Disclosure

The disclosure is related to a voltage generating device and a calibrating method thereof.

Description of Related Art

Among many electronic circuits, generally a reference voltage that is stable and accurate is required. Bandgap (or energy gap) circuits are commonly applied in electronic circuit to provide reference voltage.

SUMMARY

An embodiment of the disclosure provides a voltage generating device. The voltage generating device includes a bandgap circuit, a regulator circuit and a calibrating circuit. The bandgap circuit includes a chopper amplifier and at least one bandgap circuit resistor. The bandgap circuit provides a bandgap voltage. The regulator circuit is coupled to the bandgap circuit to receive bandgap voltage. The regulator circuit can generate an output voltage correspondingly according to the bandgap voltage. The regulator circuit includes at least one regulator resistor. The calibrating circuit is coupled to the bandgap circuit to receive the bandgap voltage. The calibrating circuit is coupled to the regulator circuit to receive the output voltage. In the first stage of the calibration period, the calibrating circuit detects the bandgap voltage and correspondingly sets the resistance of at least one resistor among the bandgap circuit resistor according to the bandgap voltage. In the second stage of the calibration period, the calibrating circuit detects the output voltage and correspondingly sets the resistance of at least one resistor among the regulator resistor according to the output voltage.

An embodiment of the disclosure further provides a calibrating method of a voltage generating device. The calibrating method includes providing a bandgap voltage by a bandgap circuit, wherein the bandgap circuit includes a chopper amplifier and at least one bandgap circuit resistor; in the first stage of the calibration period, detecting the bandgap voltage by a calibrating circuit, and setting a resistance of at least one resistor among the bandgap circuit resistor correspondingly according to the bandgap voltage; generating an output voltage correspondingly by a regulator circuit according to the bandgap voltage, wherein the regulator circuit includes at least one regulator resistor; and in the second stage of the calibration period, detecting the output voltage by the calibrating circuit and setting the resistance of at least one resistor among the regulator resistor correspondingly according to the output voltage.

In order to make the aforementioned features and advantages of the disclosure more comprehensible, embodiments accompanying figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF EMBODIMENTS

Figure 1:
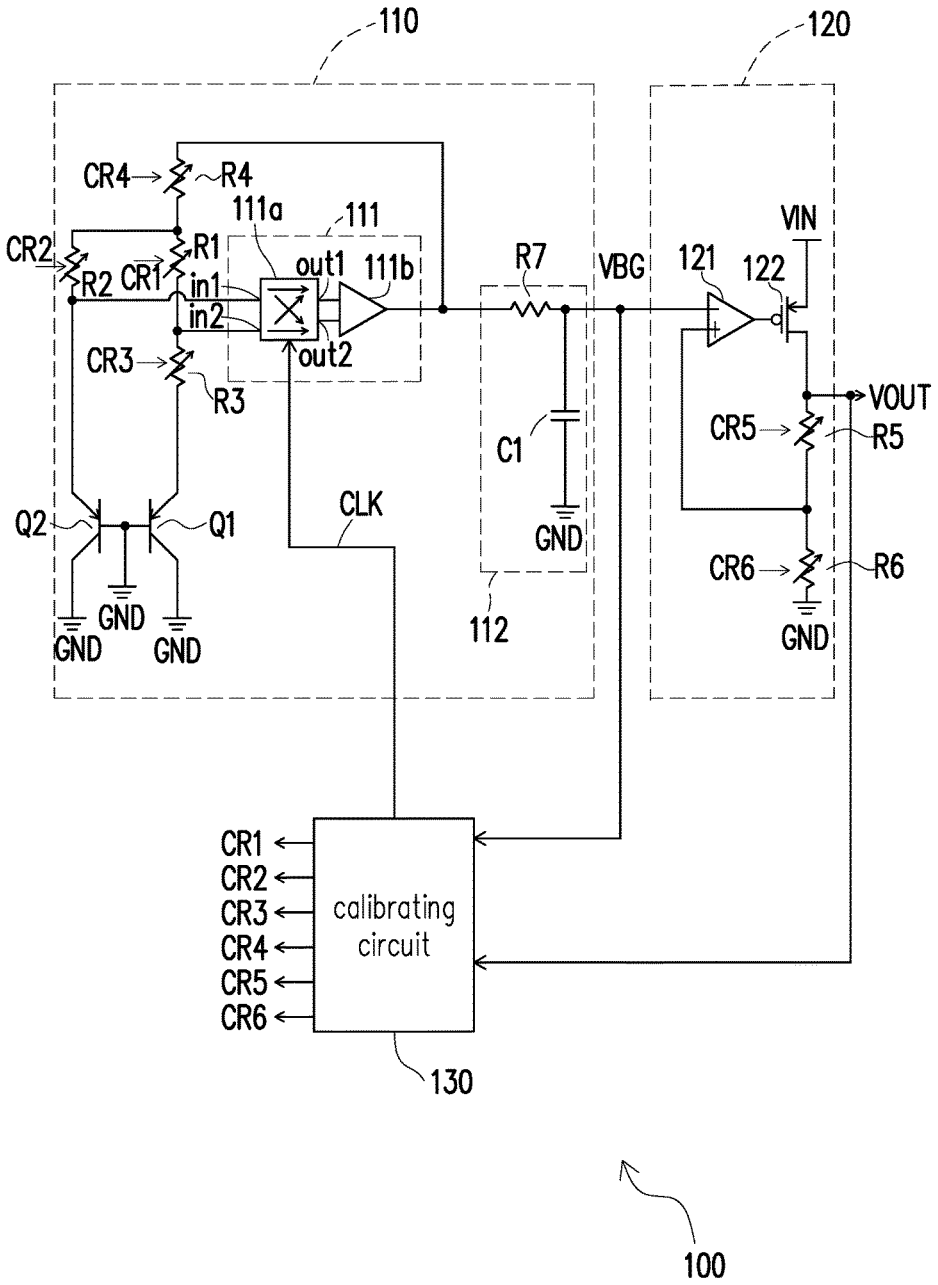
FIG. 1 is a schematic circuit block diagram illustrating a voltage generating device according to an embodiment of the disclosure.

Reference will now be made in detail to the present preferred embodiments of the disclosure, examples of which are illustrated in the accompanying drawings. Wherever possible, the same reference numbers are used in the drawings and the description to refer to the same or like parts. Moreover, elements/components/steps with same reference numerals represent same or similar parts in the drawings and embodiments. Elements/components/notations with the same reference numerals in different embodiments may be referenced to the related description. "Coupling" used in the full disclosure (including the claims) can refer to any direct or indirect connection means. For example, in the disclosure, if the first apparatus is coupled to the second apparatus, it should be interpreted that the first apparatus can be directly connected to the second apparatus, or the first apparatus can be indirectly connected to the second apparatus through another apparatus or a certain connection means.

The disclosure provides a voltage generating device and a calibrating method thereof to provide a stable and accurate output voltage.

According to the examples of the disclosure, the voltage generating device and the calibrating method thereof calibrate the resistor of a bandgap circuit first in a calibration period, and then calibrates the resistor of a regulator circuit. The voltage generating device adopts the bandgap circuit having a chopper amplifier to provide a stable and accurate bandgap voltage and the regulator circuit is adopted to provide a driving ability.

In order to increase accuracy of the output voltage of the voltage generating device and to reduce temperature drift, the following embodiments provide an improved trimming celebration method. In the test period (calibration period), the calibrating method in the following examples performs two times of measurement and two times of trimming in two stages, thereby calibrating process offset and offset variation, and thus save time and cost.

In some embodiments, a clock signal is used in the first stage of the calibration period, and the clock signal is not used in the second stage of the calibration period and a normal operation period. Therefore, in the second stage of the calibration period and the normal operation period, there is no periodic noise overlaying the output voltage.

FIG. 1 is a schematic circuit block diagram illustrating a voltage generating device 100 according to an embodiment of the disclosure. The voltage generating device 100 includes a bandgap (or energy gap) circuit 110, a regulator circuit 120 and a calibrating circuit 130. The bandgap circuit 110 may provide a bandgap voltage VBG. The bandgap circuit 110 includes a chopper amplifier 111 and at least one bandgap circuit resistor. In the embodiment shown in FIG. 1, the bandgap circuit resistor includes a first resistor R1, a second resistor R2, a third resistor R3 and a fourth resistor R4. A first terminal of the second resistor R2 is coupled to a first terminal of the first resistor R1. A second terminal of the first resistor R1 is coupled to a second input terminal of the chopper amplifier 111. A second terminal of the second resistor R2 is coupled to a first input terminal of the chopper amplifier 111. A first terminal of the third resistor R3 is coupled to the second terminal of the first resistor R1. A first terminal of the fourth resistor R4 is coupled to an output terminal of the chopper amplifier 111. A second terminal of the fourth resistor R4 is coupled to the first terminal of the first resistor R1 and the first terminal of the second resistor R2.

In FIG. 1, the first resistor R1, the second resistor R2, the third resistor R3 and the fourth resistor R4 may be a variable resistor. The implementation of the variable resistor may be realized depending on the need of design. For example, the first resistor R1, the second resistor R2, the third resistor R3 and the fourth resistor R4 may be a known variable resistor or other variable resistor element/circuit. The calibrating circuit 130 may output a resistance trimming command CR1, CR2, CR3 and CR4 to respectively control/set the resistance of the first resistor R1, the second resistor R2, the third resistor R3 and the fourth resistor R4.

According to the need of design, one or more of the first resistor R1, the second resistor R2, the third resistor R3 and the fourth resistor R4 may be changed into a constant resistor. For example, in other embodiments, the first resistor R1, the second resistor R2 and the fourth resistor R4 may be a variable resistor, and the third resistor R3 may be a constant resistor. Correspondingly, the resistance trimming command CR3 may be omitted. Alternatively, in other embodiments, the fourth resistor R4 may be a variable resistor, and the first resistor R1, the second resistor R2 and the third resistor R3 may be a constant resistor. Correspondingly, the resistance trimming command CR1, CR2 and CR3 may be omitted.

In the embodiment shown in FIG. 1, the bandgap circuit 110 further includes a first transistor Q1, a second transistor Q2 and a low-pass filtering circuit 112. A first terminal (e.g., emitter) of the first transistor Q1 is coupled to a second terminal of the third resistor R3. A second terminal (e.g., collector) and a control terminal (e.g., base) of the first transistor Q1 are coupled to a reference voltage GND. A first terminal (e.g., emitter) of the second transistor Q2 is coupled to a second terminal of the second resistor R2. A second terminal (e.g., collector) and a control terminal (e.g., base) of the second transistor Q2 are coupled to the reference voltage GND. An input terminal of the low-pass filtering circuit 112 is coupled to an output terminal of the chopper amplifier 111. An output terminal of the low-pass filtering circuit 112 outputs the bandgap voltage VBG to the regulator circuit 120.

The implementation of the chopper amplifier 111 may be realized depending on the need of design. For example, the chopper amplifier 111 may be a known chopper amplifier or other chopper amplifying element/circuit. In the embodiment shown in FIG. 1, the chopper amplifier 111 includes a routing circuit 111*a* and an operational amplifier 111*b*. The routing circuit 111*a* has a first input terminal in1, a second input terminal in2, a first output terminal out1, a second output terminal out2 and a control terminal. The control terminal of the routing circuit 111*a* is coupled to the calibrating circuit 130 to receive the clock signal CLK. When the clock signal CLK is a first logic level (e.g., low logic level), the first input terminal in1 of the routing circuit 111*a* is electrically connected to the first output terminal out1 of the routing circuit 111*a*, and the second input terminal in2 of the routing circuit 111*a* is electrically connected to the second output terminal out2 of the routing circuit 111*a*. When the signal clock CLK is the second logic level (e.g., high logic level), the first input terminal in1 of the routing circuit 111*a* is electrically connected to the second output terminal out2 of the routing circuit 111*a* and the second input terminal in2 of the routing circuit 111*a* is electrically connected to the first output terminal out1 of the routing circuit 111*a*. A first input terminal of the operational amplifier 111*b* is coupled to the first output terminal out1 of the routing circuit 111*a*. A second input terminal of the operational amplifier 111*b* is coupled to the second output terminal out2 of the routing circuit 111*a*, and an output terminal of the operational amplifier 111*b* serves as the output terminal of the chopper amplifier 111.

The implementation of the low-pass filtering circuit 112 may be realized depending on the need of design. For example, the low-pass filtering circuit 112 may be a known low-pass filtering circuit or other low-pass filtering element/circuit. In the embodiment shown in FIG. 1, the low-pass filtering circuit 112 includes a resistor R7 and a capacitor C1. A first terminal of the resistor R7 is coupled to the output terminal of the chopper amplifier 111. A second terminal of the resistor R7 outputs the bandgap voltage VBG to the regulator circuit 120. A first terminal of the capacitor C1 is coupled to the second terminal of the resistor R7. A second terminal of the capacitor C1 is coupled to the reference voltage GND.

In the embodiment shown in FIG. 1, the regulator circuit 120 is coupled to the bandgap circuit 110 to receive the bandgap voltage VBG. By using the electrical energy of an input voltage VIN, the regulator circuit 120 can generate an output voltage VOUT correspondingly according to the bandgap voltage VBG. The implementation of the regulator circuit 120 may be realized depending on the need of design. For example, the regulator circuit 120 may be a known regulator circuit or other regulating element/circuit.

The regulator circuit 120 includes at least one regulator resistor. In the example shown in FIG. 1, the regulator resistor includes a resistor R5 and a resistor R6. A first terminal of the resistor R6 is coupled to a first terminal of the resistor R5. A second terminal of the resistor R6 is coupled to the reference voltage GND. The resistor R5 and the resistor R6 shown in FIG. 1 may be a variable resistor. The implementation of the variable resistor may be realized depending on the need of design. For example, the resistor R5 and the resistor R6 may be a known variable resistor or other variable resistor element/circuit. The calibrating circuit 130 may output a resistance trimming command CR5 and CR6 to respectively control/set the resistance of the resistor R5 and the resistor R6.

According to the need of design, one or more of the resistor R5 and the resistor R6 may be changed into a constant resistor. For example, in other embodiments, the resistor R5 may be a variable resistor, and the resistor R6 may be a constant resistor. Correspondingly, the resistance trimming command CR6 may be omitted. Alternatively, in other embodiments, the resistor R6 may be a variable resistor, and the resistor R5 may be a constant resistor. Correspondingly, the resistance trimming command CR5 may be omitted.

The regulator circuit 120 further includes an error amplifier 121 and a power transistor 122. A first input terminal (e.g., inverse input terminal) of the error amplifier 121 is coupled to the output terminal of the bandgap circuit 110 to receive the bandgap voltage VBG. A second input terminal (e.g., non-inverse input terminal) of the error amplifier 121 is coupled to a first terminal of the resistor R5 and a first terminal of the resistor R6. A first terminal (e.g., source) of the power transistor 122 is coupled to the input voltage VIN. A control terminal (e.g., gate) of the power transistor 122 is coupled to an output terminal of the error amplifier 121. A second terminal (e.g., drain) of the power transistor 122 is coupled to the second terminal of the resistor R5. A voltage of the second terminal of the power transistor 122 is the output voltage VOUT.

The calibrating circuit 130 is coupled to the bandgap circuit 110 to receive the bandgap voltage VBG. The calibrating circuit 130 is coupled to the regulator circuit 120 to receive the output voltage VOUT. In the first stage of the calibration period, the calibrating circuit 130 detects the bandgap voltage VBG, and correspondingly sets the resistance of at least one resistor among the bandgap circuit resistor (R1, R2, R3 and/or R4 in FIG. 1) according to the bandgap voltage VBG. In the second stage of the calibration period, the calibrating circuit 130 detects the output voltage VOUT, and correspondingly sets the resistance of at least one resistor among the regulator resistor (R5 and/or R6 shown in FIG. 1) according to the output voltage VOUT.

Figure 2:
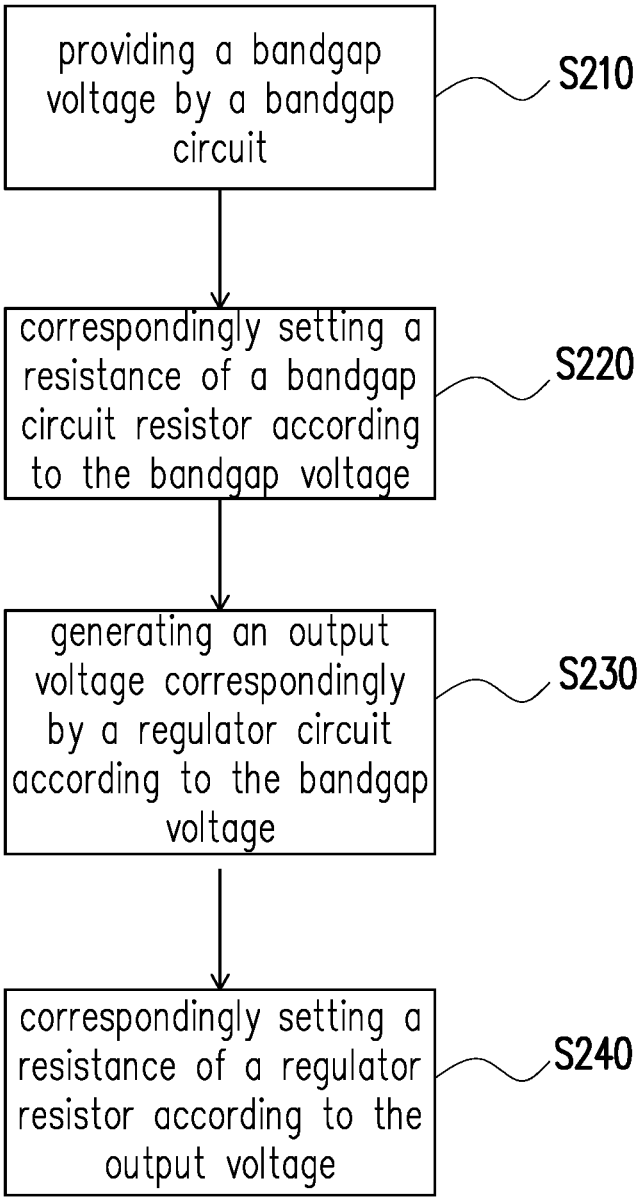
FIG. 2 is a schematic diagram illustrating a flowchart of a calibrating method of a voltage degenerating device according to an embodiment of the disclosure.

FIG. 2 is a schematic diagram illustrating a flowchart of a calibrating method of a voltage degenerating device according to an embodiment of the disclosure. Referring to FIG. 1 and FIG. 2, in step S210, the bandgap circuit 110 may provide the bandgap voltage VBG to the regulator circuit 120. The bandgap circuit 110 includes the chopper amplifier 111 and the at least one bandgap circuit resistor (e.g., R1, R2, R3 and/or R4 shown in FIG. 1). In the first stage (step S220) of the calibration period, the calibrating circuit 130 may provide the clock signal CLK to the chopper amplifier 111. Also, the calibrating circuit 130 may detect the bandgap voltage VBG. The duty cycle of the clock signal CLK may be determined depending on the need of design. For example, the duty cycle of the clock signal CLK may be 50% or other ratio. Meanwhile, the bandgap voltage VBG is only affected by the process drift.

According to the bandgap voltage VBG, the calibrating circuit 130 may correspondingly set the resistance of at least one resistor among the bandgap circuit resistor in the first stage (step S220) of the calibration period. Here, the resistor R4 serves as an example for description; the other resistors R1, R2 and/or R3 may be deduced from the reference to the resistor R4. In some embodiments, poly fuse, efuse or other approach may be employed to control/set the resistance of the resistor R4. In other embodiments, a flip-flop, a central processing unit (CPU) or a microcontroller unit (MCU) is employed to control logic bits so as to control/set the resistance of the resistor R4.

In the first stage (step S220) of the calibration period, the calibrating circuit 130 may detect the bandgap voltage VBG to obtain the currently detected value. The bandgap voltage VBG=VBE1+(VT·ln(n)) [1+(R1+2*R4)/R3] VOFF1. According to the equation, the variation ΔR4 of the resistor R4 causes the variation of the bandgap voltage VBG to be ΔVBG=(VT·ln(n))(2*ΔR4)/R3. By comparing the ideal value (designed target value) VBGi of the bandgap voltage VBG with the currently detected value at the moment, a difference ΔVBG between the two can be obtained. According to variation ΔVBG, the variation ΔR4 of the resistance of the resistor R4 can be inferred. Here, the corresponding relationship between one ΔR4 and one ΔVBG is referred to as bandgap voltage trimming step. The finer the resolution of the resistor R4, the more the trimming step of the bandgap voltage VBG, such that the currently detected value of the bandgap voltage VBG can be closer to the ideal value (designed target value) VBGi. After the first stage (step S220) is completed, the temperature coefficient of the bandgap voltage VBG may be improved.

In some embodiments, the calibrating circuit 130 may be provided with a look up table. The calibrating circuit 130 can obtain a resistance setting information of the resistor R4 from the look up table according to the currently detected value of the bandgap voltage VBG so as to control/set the resistance of the resistor R4 using the resistance trimming command CR4 according to the resistance setting information. In other embodiments, the calibrating circuit 130 may be provided with a calculating circuit. The calculating circuit of the calibrating circuit 130 can calculate the currently detected value of the bandgap voltage VBG to obtain the resistance setting information of the resistor R4 so as to control/set the resistance of the resistor R4 using the resistance trimming command CR4 according to the resistance setting information.

In step S230, the regulator circuit 120 may correspondingly generate the output voltage VOUT according to the bandgap voltage VBG. The regulator circuit 120 includes at least one regulator resistor (e.g., R5 and/or R6 shown in FIG. 1). In the second stage (step S240) of the calibration period, the calibrating circuit 130 does not provide the clock signal CLK to the chopper amplifier 111; meanwhile, the calibrating circuit 130 may detect the output voltage VOUT. In terms of "not providing clock signal CLK", for example, the calibrating circuit 130 may maintain the voltage level of the clock signal CLK at a high logic level. In other embodiments, the calibrating circuit 130 may maintain the voltage level of the clock signal CLK in the second stage (step S240) of the calibration period at a low logic level. In the condition that "the clock signal CLK is not provided", the bandgap voltage VBG no longer has the noise caused by the clock signal CLK, and thus the output voltage VOUT does not have the noise caused by the clock signal CLK.

In the second stage (step S240) of the calibration period, the calibrating circuit 130 may detect the output voltage VOUT to obtain the currently detected value, and correspondingly control/set the resistance of at least one resistor among the regulator resistor (e.g., R5 and/or R6 shown in FIG. 1) according to the output voltage VOUT. Here, the resistor R5 serves as an example for description, and the other resistor R6 may be deduced from reference to the resistor R5. In some embodiments, the poly fuse, efuse and other approach may be employed to control/set the resistance of the resistor R5. In other embodiments, the flip-flop, the central processing unit (CPU) or the microcontroller unit (MCU) can be employed to control logic bits so as to control/set the resistance of the resistor R5.

In the second stage (step S240) of the calibration period, the calibrating circuit 130 may detect the output voltage VOUT to obtain the currently detected value. The output voltage VOUT=VBG*(1+R5/R6)+(1+R5/R6)*VOFF2, namely, VOUT=VBG*(1+R5/R6)+(1+R5/R6)*VOFF1+

VOFF2, wherein VOFF1 is an offset of the operational amplifier 111*b*, and VOFF2 is an offset of the error amplifier 121. According to the equation, the variation ΔR5 of the resistor R5 causes the variation of the output voltage VOUT to be ΔVOUT=(ΔR5/R6)*VBG+(ΔR5/R6)*VOFF1+(ΔR5/R6)*VOFF2. Generally speaking, VBG is about 1.2V, and the offset may be about several (or a dozen) mV; as a result, they are different by two orders. Therefore, the equation can be simplified as ΔVOUT≈(ΔR5/R6)*VBG. By comparing the ideal value (designed target value) of the output voltage VOUT with the currently detected value at the moment, the difference ΔVOUT of the two can be obtained. According to the variation ΔVOUT, the variation ΔR5 of the resistance of the resistor R5 can be inferred. Here, the corresponding relationship between one ΔR5 and one ΔVOUT is referred to as an output voltage trimming step. The finer the resolution of the resistor R5, the more trimming step of the output voltage VOUT, such that the currently detected value of the output voltage VOUT can be closer to the ideal value (designed target value). By trimming the resistor R5 in the second stage (step S240), the effect on the accuracy of the output voltage VOUT caused by the offset VOFF1 of the operational amplifier 111*b* and the offset VOFF2 of the error amplifier 121 can be corrected.

The above-mentioned steps can be performed at room temperature without having to change the temperature of the environment. After the calibration period is over, the system can enter the normal operation period. In the normal operation period, the calibrating circuit 130 does not provide the clock signal CLK to the chopper amplifier 111. In the condition that the "clock signal CLK is not provided", the output voltage VOUT does not have the noise caused by the clock signal CLK.

Figure 3:
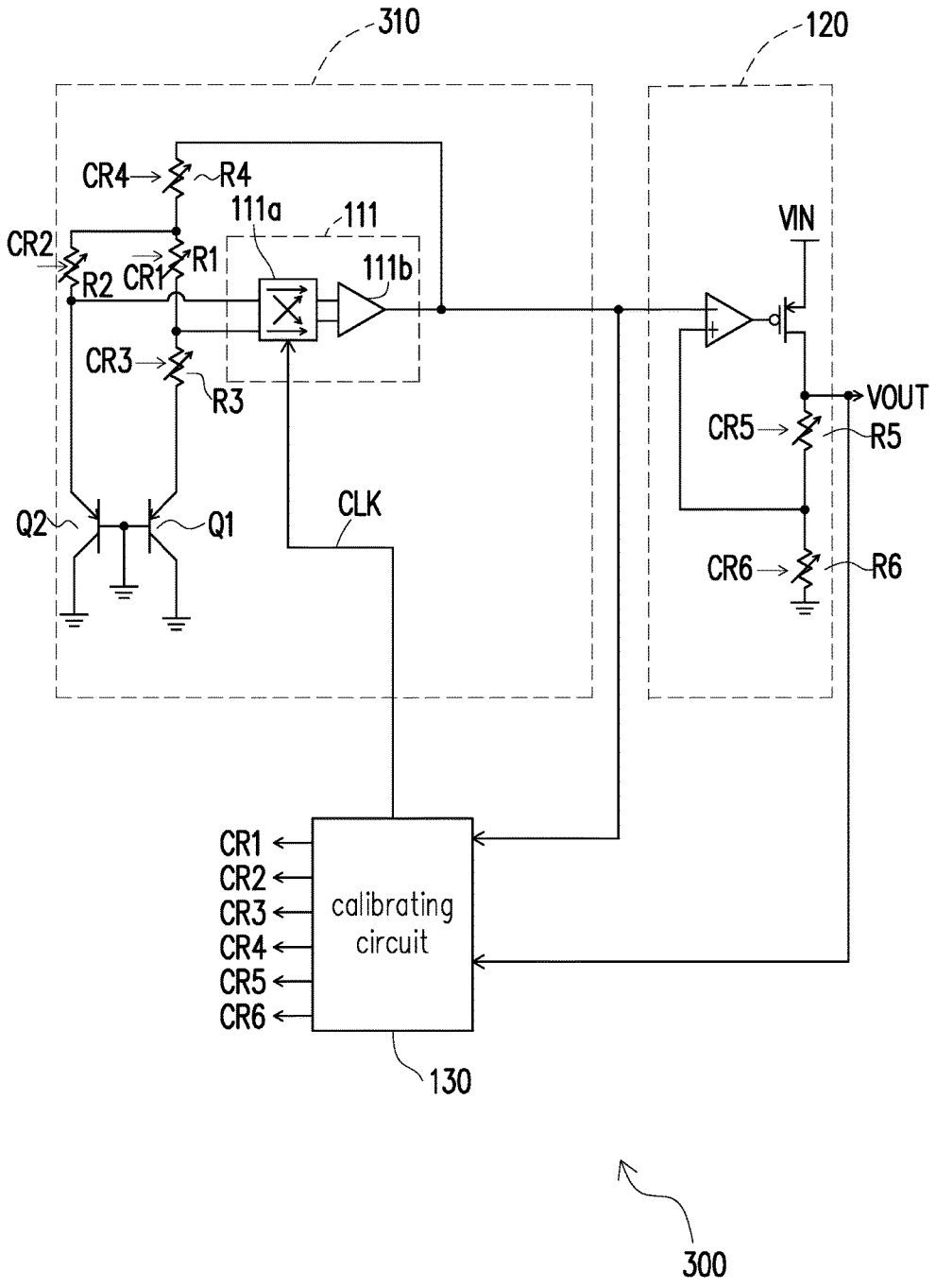
FIG. 3 is a schematic circuit block diagram illustrating a voltage generating device according to another embodiment of the disclosure.

FIG. 3 is a schematic circuit block diagram illustrating a voltage generating device according to another embodiment of the disclosure. A voltage generating device 300 includes a bandgap circuit 310, a regulator circuit 120 and a calibrating circuit 130. FIG. 1 and FIG. 2 may serve as reference for the regulator circuit 120 and the calibrating circuit 130 shown in FIG. 3, and thus no repetitions are incorporated herein. In the embodiment shown in FIG. 3, the bandgap circuit 310 includes the chopper amplifier 111 and at least one bandgap circuit resistor. In the embodiment shown in FIG. 3, the bandgap circuit resistor includes the first resistor R1, the second resistor R2, the third resistor R3 and the fourth resistor R4. The bandgap circuit 110 further includes the first transistor Q1 and the second transistor Q2. In FIG. 1 and FIG. 2, the descriptions regarding the bandgap circuit 110, the resistors R1-R4, the transistors Q1-Q2 and the chopper amplifier 111 may serve as reference for the bandgap circuit 310, the resistors R1-R4, the transistors Q1-Q2 and the chopper amplifier 111 illustrated in FIG. 3; therefore, no repetitions are incorporated herein. In the embodiment of FIG. 3, the output terminal of the chopper amplifier 111 may serve as the output terminal of the bandgap circuit 310 to provide the bandgap voltage VBG to the regulator circuit 120.

Figure 4:
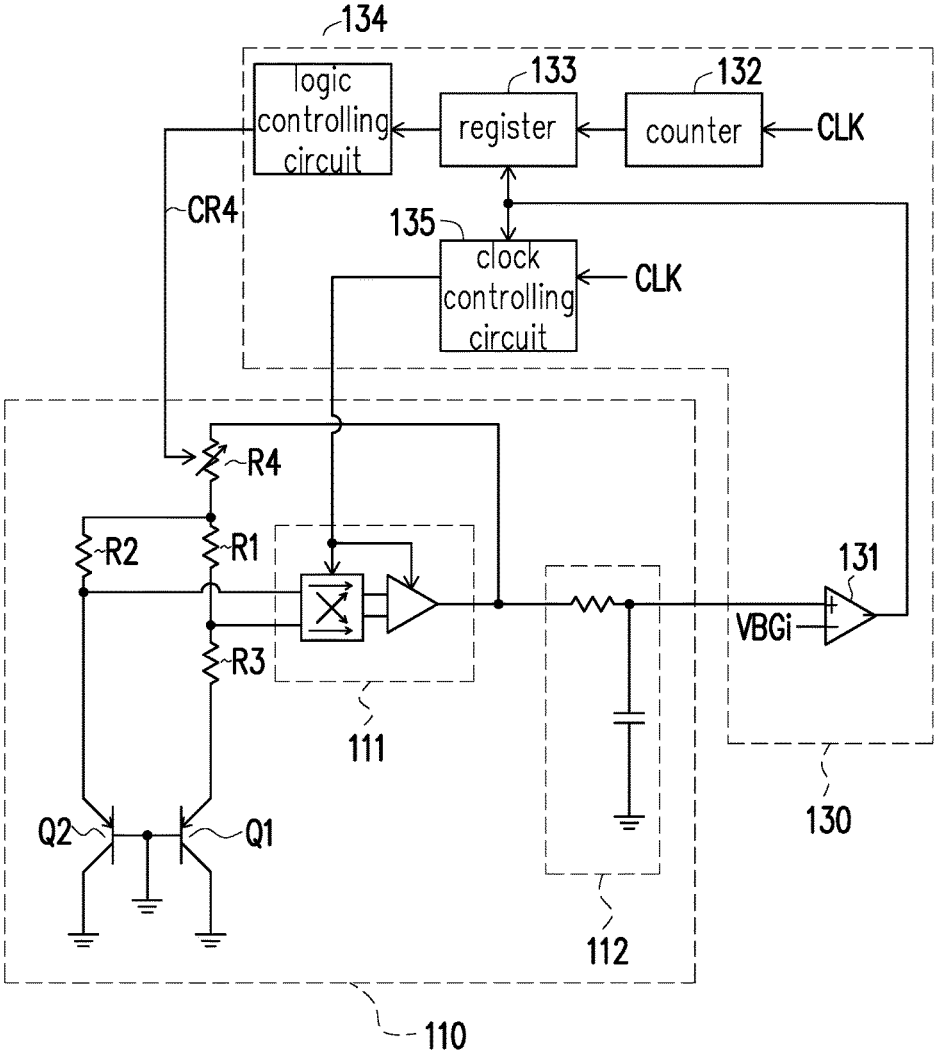
FIG. 4 is a schematic circuit block diagram illustrating a calibrating circuit shown in FIG. 1 according to an embodiment of the disclosure.

FIG. 4 is a schematic circuit block diagram illustrating a calibrating circuit shown in FIG. 1 according to an embodiment of the disclosure. In the embodiment of FIG. 4, the calibrating circuit 130 includes a voltage comparator 131, a counter 132, a register 133, a logic controlling circuit 134 and a clock controlling circuit 135. A first input terminal (e.g., non-inverse input terminal) of the voltage comparator 131 is coupled to the output terminal of the bandgap circuit 110 to receive the bandgap voltage VBG. A second input terminal (e.g., inverse input terminal) of the voltage comparator 131 receives the reference voltage. The reference voltage may be determined depending on the need of design. For example, the reference voltage may be an ideal value (designed target value) VBGi of the bandgap voltage VBG. The voltage comparator 131 may compare the bandgap voltage VBG with the reference voltage, and an output terminal of the voltage comparator 131 outputs the comparing result to the register 133 and the clock controlling circuit 135.

The counter 132 may count the clock signal CLK and output and the counted value to the register 133. The register 133 has a storage result therein, and the storage result is provided to the logic controlling circuit 134. The register 133 is coupled to the counter 132 to receive the counted value. The register 133 is coupled to the voltage comparator 131 to receive the comparing result. When the comparing result is the first logic level (e.g., low logic level), it represents that the bandgap voltage VBG does not match the ideal value (designed target value) VBGi; as a result, the register 133 updates the storage result according to the counted value of the counter 132. When the comparing result is the second logic level (e.g., high logic level), it represents that the bandgap voltage VBG matches the ideal value (designed target value) VBGi and thus the register 133 does not update the storage result.

The logic controlling circuit 134 is coupled to the register 133 to receive the storage result. The logic controlling circuit 134 can correspondingly adjust the resistance trimming command CR4 according to the storage result of the register 133, and output the resistance trimming command CR4 to at least one resistor R4 among the bandgap circuit resistor to set the resistance of the resistor R4.

An input terminal of the clock controlling circuit 135 receives the clock signal CLK. An output terminal of the clock controlling circuit 135 is coupled to the chopper amplifier 111. A control terminal of the clock controlling circuit 135 is coupled to the output terminal of the voltage comparator 131 to receive the comparing result. When the comparing result is the first logic level (e.g., low logic level), it represents that the bandgap voltage VBG does not match the ideal value (designed target value) VBGi; as a result, the clock controlling circuit 135 provides the clock signal CLK to the chopper amplifier 111. When the comparing result is the second logic level (e.g., high logic level), it represents that the bandgap voltage VBG matches the ideal value (designed target value) VBGi; as a result, the clock controlling circuit 135 does not provide the clock signal CLK to the chopper amplifier 111.

It should be indicated that, in different application environments, the related functions of the calibrating circuit 130 may be realized as software, firmware or hardware using general programming languages (e.g., C or C++), hardware description languages (e.g., Verilog HDL or VHDL) or other suitable programming languages. The program languages that can execute related functions may be arranged as any known computer-accessible medias such as magnetic tapes, semiconductors memory, magnetic disks or compact disks (e.g., CD-ROM or DVD-ROM), or through Internet, wired communication, wireless communication or other communication medium to transmit the program languages. The program languages may be stored in the accessible medias of the computer so as for the processor of the computer to access/execute the programming codes of the software (or firmware). In terms of realization of hardware, one or more controllers, microcontrollers, microprocessors, application-specific integrated circuits (ASIC), digital signal processors (DSP), field programmable gate arrays (FPGA) and/or various logic blocks, modules and circuits in other processing units may be used to realize or execute the functions described in the embodiments. Additionally, the device and the method provided by the disclosure can be realized through the combination of hardware and software.

In summary of the above, with the voltage generating device and the calibrating method described in the embodiments of the disclosure, the resistor of the bandgap circuit is calibrated first in the first stage of the calibration period, and then the resistor of the regulator circuit is calibrated in the second stage of the calibration period. The voltage generating device adopts the bandgap circuit having the chopper amplifier to provide stable and accurate bandgap voltage as well as the regulator circuit to provide the driving ability. In the second stage of the calibration period and the normal operation period, the clock signal is not provided to the chopper amplifier, and thus the clock noise (switch noise) of the chopper amplifier can be eliminated.

Although the disclosure has been disclosed by the above embodiments, the embodiments are not intended to limit the disclosure. It will be apparent to those skilled in the art that various modifications and variations can be made to the structure of the disclosure without departing from the scope or spirit of the disclosure. Therefore, the protecting range of the disclosure falls in the appended claims.

What is claimed is:

1. A voltage generating device, comprising:

a bandgap circuit, comprising a chopper amplifier and at least one bandgap circuit resistor, wherein the bandgap circuit provides a bandgap voltage;

a regulator circuit, coupled to the bandgap circuit to receive the bandgap voltage, generating an output voltage correspondingly according to the bandgap voltage, wherein the regulator circuit comprises at least one regulator resistor; and a calibrating circuit, coupled to the bandgap circuit to receive the bandgap voltage, coupled to the regulator circuit to receive the output voltage, wherein in a first stage of a calibration period, the calibrating circuit detects the bandgap voltage and correspondingly sets a resistance of at least one resistor among the at least one bandgap circuit resistor according to the bandgap voltage, and in a second stage of the calibration period, the calibrating circuit detects the output voltage and correspondingly sets a resistance of at least one resistor among the at least one regulator resistor according to the output voltage;

wherein the calibrating circuit provides a clock signal to the chopper amplifier in the first stage of the calibration period, and the calibrating circuit does not provide the clock signal to the chopper amplifier in the second stage of the calibration period and a normal operation period.

2. The voltage generating device according to claim 1, wherein the chopper amplifier comprises:

a routing circuit, having a first input terminal, a second input terminal, a first output terminal, a second output terminal and a control terminal, wherein the control terminal of the routing circuit is coupled to the calibrating circuit to receive the clock signal, the first input terminal of the routing circuit is electrically connected to the first output terminal of the routing circuit and the second input terminal of the routing circuit is electrically connected to the second output terminal of the routing circuit when the clock signal is a first logic level, and the first input terminal of the routing circuit is electrically connected to the second output terminal of the routing circuit and the second input terminal of the routing circuit is electrically connected to the first output terminal of the routing circuit when the clock signal is a second logic level; and an operational amplifier, having a first input terminal, a second input terminal and an output terminal, wherein the first input terminal of the operational amplifier is coupled to the first output terminal of the routing circuit, the second input terminal of the operational amplifier is coupled to the second output terminal of the routing circuit, and the output terminal of the operational amplifier serves as an output terminal of the chopper amplifier.

3. The voltage generating device according to claim 1, wherein the at least one bandgap circuit resistor comprises a first resistor, a second resistor, a third resistor and a fourth resistor, a first terminal of the second resistor is coupled to a first terminal of the first resistor, a second terminal of the second resistor is coupled to a first input terminal of the chopper amplifier, a second terminal of the first resistor is coupled to a second input terminal of the chopper amplifier, a first terminal of the third resistor is coupled to the second terminal of the first resistor, a first terminal of the fourth resistor is coupled to an output terminal of the chopper amplifier, a second terminal of the fourth resistor is coupled to the first terminal of the first resistor, and the bandgap circuit further comprises:

a first transistor, a first terminal of the first transistor coupled to a second terminal of the third resistor, a second terminal and a control terminal of the first transistor coupled to a reference voltage;

a second transistor, a first terminal of the second transistor coupled to the second terminal of the second resistor, a second terminal and a control terminal of the second transistor coupled to the reference voltage; and a low-pass filtering circuit, an input terminal of the low-pass filtering circuit coupled to the output terminal of the chopper amplifier, an output terminal of the low-pass filtering circuit outputting the bandgap voltage to the regulator circuit.

4. The voltage generating device according to claim 3, wherein the low-pass filtering circuit comprises:

a resistor, a first terminal of the resistor coupled to the output terminal of the chopper amplifier, a second terminal of the resistor outputting the bandgap voltage to the regulator circuit; and a capacitor, a first terminal of the capacitor coupled to the second terminal of the resistor, a second terminal of the capacitor coupled to the reference voltage.

5. The voltage generating device according to claim 1, wherein an output terminal of the chopper amplifier serves as an output terminal of the bandgap circuit to provide the bandgap voltage to the regulator circuit, the at least one bandgap circuit resistor comprises a first resistor, a second resistor, a third resistor and a fourth resistor, a first terminal of the second resistor is coupled to a first terminal of the first resistor, a second terminal of the second resistor is coupled to a first input terminal of the chopper amplifier, a second terminal of the first resistor is coupled to a second input terminal of the chopper amplifier, a first terminal of the third resistor is coupled to the second terminal of the first resistor, a first terminal of the fourth resistor is coupled to the output terminal of the chopper amplifier, a second terminal of the fourth resistor is coupled to the first terminal of the first resistor, the bandgap circuit further comprises:

a first transistor, a first terminal of the first transistor coupled to a second terminal of the third resistor, a second terminal and a control terminal of the first transistor coupled to a reference voltage; and a second transistor, a first terminal of the second transistor coupled to the second terminal of the second resistor, a second terminal and a control terminal of the second transistor coupled to the reference voltage.

6. The voltage generating device according to claim 1, wherein the at least one regulator resistor comprises a first resistor and a second resistor, a first terminal of the second resistor is coupled to a first terminal of the first resistor, a second terminal of the second resistor is coupled to a reference voltage, the regulator circuit further comprises:

an error amplifier, a first input terminal of the error amplifier coupled to an output terminal of the bandgap circuit to receive the bandgap voltage, a second input terminal of the error amplifier coupled to the first terminal of the first resistor; and a power transistor, a first terminal of the power transistor coupled to an input voltage, a control terminal of the power transistor coupled to an output terminal of the error amplifier, a second terminal of the power transistor coupled to a second terminal of the first resistor, the second terminal of the power transistor outputting the output voltage.

7. A voltage generating device, comprising:

a bandgap circuit, comprising a chopper amplifier and at least one bandgap circuit resistor, wherein the bandgap circuit provides a bandgap voltage;

a regulator circuit, coupled to the bandgap circuit to receive the bandgap voltage, generating an output voltage correspondingly according to the bandgap voltage, wherein the regulator circuit comprises at least one regulator resistor;

a calibrating circuit, coupled to the bandgap circuit to receive the bandgap voltage, coupled to the regulator circuit to receive the output voltage, wherein in a first stage of a calibration period, the calibrating circuit detects the bandgap voltage and correspondingly sets a resistance of at least one resistor among the at least one bandgap circuit resistor according to the bandgap voltage, and in a second stage of the calibration period, the calibrating circuit detects the output voltage and correspondingly sets a resistance of at least one resistor among the at least one regulator resistor according to the output voltage, wherein the calibration circuit comprises:

a voltage comparator, a first input terminal of the voltage comparator coupled to an output terminal of the bandgap circuit to receive the bandgap voltage, a second input terminal of the voltage comparator receiving a reference voltage, and an output terminal of the voltage comparator outputting a comparing result;

a counter, counting a clock signal and outputting a counted value;

a register, coupled to the counter to receive the counted value, and coupled to the voltage comparator to receive the comparing result, wherein the register updates a storage result according to the counted value when the comparing result is a first logic level, and the register does not update the storage result when the comparing result is a second logic level; and a logic controlling circuit, coupled to the register to receive the storage result, the logic controlling circuit correspondingly adjusting a resistance trimming command according to the storage result, and outputting the resistance trimming command to the at least one resistor among the at least one bandgap circuit resistor to set the resistance of the at least one resistor among the at least one bandgap circuit resistor.

8. The voltage generating device according to claim 7, wherein the calibrating circuit further comprises:

a clock controlling circuit, having an input terminal receiving the clock signal, wherein an output terminal of the clock controlling circuit is coupled to the chopper amplifier, a control terminal of the clock controlling circuit is coupled to the output terminal of the voltage comparator to receive the comparing result, the clock controlling circuit provides the clock signal to the chopper amplifier when the comparing result is the first logic level, and the clock controlling circuit does not provide the clock signal to the chopper amplifier when the comparing result is the second logical level.

9. A calibrating method of a voltage generating device, comprising:

providing a bandgap voltage by a bandgap circuit, wherein the bandgap circuit comprises a chopper amplifier and at least one bandgap circuit resistor;

in a first stage of a calibration period, detecting the bandgap voltage by a calibrating circuit, and correspondingly setting a resistance of at least one resistor of the at least one bandgap circuit resistor according to the bandgap voltage;

generating an output voltage correspondingly by a regulator circuit according to the bandgap voltage, wherein the regulator circuit comprises at least one regulator resistor;

in a second stage of the calibration period, detecting the output voltage by the calibrating circuit, and correspondingly setting a resistance of at least one resistor of the at least one regulator resistor according to the output voltage;

providing a clock signal to the chopper amplifier by the calibrating circuit in the first stage of the calibration period; and not providing the clock signal to the chopper amplifier in the second stage of the calibration period and a normal operation period.

* * * * *